US005740683A

United States Patent [19]

Billingham et al.

[11] Patent Number: 5,740,683

[45] Date of Patent: Apr. 21, 1998

[54] CRYOGENIC RECTIFICATION REGENERATOR SYSTEM

[75] Inventors: John Fredric Billingham, Getzville; Thomas John Bergman, Jr., Clarence Center, both of N.Y.

[73] Assignee: Praxair Technology, Inc., Danbury, Conn.

[21] Appl. No.: 826,135

[22] Filed: Mar. 27, 1997

[51] Int. Cl.[6] ..... F25J 1/00

[52] U.S. Cl. ..... 62/644; 62/641; 62/909

[58] Field of Search ..... 62/641, 644, 909

[56] References Cited

U.S. PATENT DOCUMENTS

| | | | |
|---|---|---|---|
| 2,671,324 | 3/1954 | Trumpler | 62/175.5 |
| 3,209,548 | 10/1965 | Grunberg et al. | 62/644 |
| 3,210,947 | 10/1965 | Dubs | 62/13 |
| 3,224,209 | 12/1965 | Lauer et al. | 62/644 |
| 3,421,333 | 1/1969 | Plutz et al. | 62/644 |
| 4,380,457 | 4/1983 | Rathborne et al. | 62/641 |
| 4,617,040 | 10/1986 | Yoshino | 62/37 |
| 4,668,260 | 5/1987 | Yoshino | 62/11 |
| 4,671,813 | 6/1987 | Yoshino | 62/32 |
| 4,698,079 | 10/1987 | Yoshino | 62/11 |
| 4,717,410 | 1/1988 | Grenier | 62/29 |

*Primary Examiner*—Ronald C. Capossela
*Attorney, Agent, or Firm*—Stanley Ktorides

[57] ABSTRACT

A cryogenic rectification system for producing nitrogen, especially at low production flowrates, wherein incoming feed air is cooled by a regenerator without need for cold end imbalance and wherein exogenous cryogenic liquid is added to the rectification column.

8 Claims, 3 Drawing Sheets

CRYOGENIC RECTIFICATION REGENERATOR SYSTEM

TECHNICAL FIELD

This invention relates generally to cryogenic rectification and, more particularly, to cryogenic rectification for the production of nitrogen.

BACKGROUND ART

A small user of nitrogen typically has liquid nitrogen delivered to a storage tank at the use site, and vaporizes the nitrogen from the tank to produce nitrogen gas as usage requirements dictate. This supply arrangement is costly because the nitrogen must be liquefied at the production plant, transported to the use site, and kept in the liquid state until required for use.

It is preferable that nitrogen be produced at the use site as this eliminates the liquefaction, transport and storage costs discussed above, and, indeed, large users of nitrogen typically have a production plant on site for this purpose. However refrigeration to drive such a production plant is generally produced by turboexpansion of feed air or waste gas, and for smaller plants such use of turboexpanders is generally cost prohibitive. In addition, prepurification of the air stream to remove water and carbon dioxide is typically employed in conventional plants but this is cost prohibitive on smaller plants. Finally, the use of conventional heat exchangers, such as brazed aluminum heat exchangers, to cool the incoming air and warm the product and waste streams leaving the rectification column, are also cost prohibitive on a small scale.

A regenerator might be used to recapture most of the refrigeration which would otherwise pass out of the plant with the product and waste streams, and at the same time remove water and carbon dioxide, thus enabling commercially viable operation of a much smaller plant than currently possible while avoiding the need for prepurification. In addition, the regenerator is a low cost heat exchange device compared to other heat exchangers capable of the same heat transfer duty, such as brazed aluminum heat exchangers. However, a regenerator requires very small temperature differences between feed air and waste streams for extended operation, and, because the outgoing cold streams have less thermal capacity and are at a lower temperature than the feed air, an unbalance stream must be supplied to the cold end of the regenerator in order to ensure against debilitating frost buildup by maintaining small temperature differences between the feed air and the outgoing gases. The unbalance stream could be a portion of the feed air, a portion of the product or a portion of the waste stream. Whichever way the unbalance scheme is constructed, it is complicated and reduces any advantage the use of a regenerator might bring to the operation of a small nitrogen production plant.

Accordingly, it is an object of this invention to provide a cryogenic rectification system for producing nitrogen which reduces the need for or does not require turboexpansion of a process stream to generate refrigeration and which employs regenerators having cold end unbalance requirements which are reduced over that required by conventional practice, or which are eliminated entirely.

SUMMARY OF THE INVENTION

The above and other objects, which will become apparent to one skilled in the art upon a reading of this disclosure, are attained by the present invention, one aspect of which is:

A method for producing nitrogen by the cryogenic rectification of feed air using a regenerator having a shell side and a coil side, said method comprising:

(A) cooling feed air by passing the feed air through the shell side of a regenerator during a cooling period, and introducing the cooled feed air into a column;

(B) passing exogenous cryogenic liquid into the column and separating the feed air by cryogenic rectification within the column into nitrogen vapor and oxygen-enriched liquid;

(C) condensing a first portion of the nitrogen vapor by indirect heat exchange with oxygen-enriched liquid to produce oxygen-enriched vapor;

(D) warming a second portion of the nitrogen vapor by indirect heat exchange with said cooling feed air by passing said second portion of the nitrogen vapor through the coil side of the regenerator;

(E) recovering the warmed second portion of the nitrogen vapor as product nitrogen; and (F) passing oxygen-enriched vapor through the shell side of the regenerator during a non-cooling period.

Another aspect of the invention is:

Apparatus for producing nitrogen by the cryogenic rectification of feed air comprising:

(A) a regenerator having a shell side and a coil side;

(B) a column having a top condenser;

(C) means for passing feed air into the shell side of the regenerator, means for passing feed air from the shell side of the regenerator into the column, and means for passing exogenous cryogenic liquid into at least one of the column and the top condenser;

(D) means for passing vapor from the column into the top condenser and means for passing liquid from the column into the top condenser;

(E) means for passing vapor from the upper portion of the column into the coil side of the regenerator and means for recovering vapor from the coil side of the regenerator as product nitrogen; and (F) means for passing vapor from the top condenser into the shell side of the regenerator.

Yet another aspect of the invention is:

A method for producing nitrogen by the cryogenic rectification of feed air using a regenerator having a shell side and a coil side, said method comprising:

(A) cooling feed air by passing the feed air through the shell side of a regenerator during a cooling period, and introducing the cooled feed air into a column having a top condenser;

(B) separating the feed air by cryogenic rectification within the column into nitrogen vapor and oxygen-enriched liquid;

(C) passing exogenous cryogenic liquid into the top condenser and condensing a first portion of the nitrogen vapor by indirect heat exchange with oxygen-enriched liquid to produce oxygen-enriched vapor;

(D) warming a second portion of the nitrogen vapor by indirect heat exchange with said cooling feed air by passing said second portion of the nitrogen vapor through the coil side of the regenerator;

(E) recovering the warmed second portion of the nitrogen vapor as product nitrogen; and (F) passing oxygen-enriched vapor through the shell side of the regenerator during a non-cooling period.

As used herein the term "feed air" means a mixture comprising primarily nitrogen and oxygen, such as ambient air or offgas from other processes.

As used herein the term "column" means a distillation or fractionation column or zone, i.e. a contacting column or zone, wherein liquid and vapor phases are countercurrently contacted to effect separation of a fluid mixture, as for example, by contacting of the vapor and liquid phases on a series of vertically spaced trays or plates mounted within the column and/or on packing elements such as structured or random packing. For a further discussion of distillation columns, see the Chemical Engineer's Handbook, fifth edition, edited by R. H. Perry and C. H. Chilton, McGraw-Hill Book Company, New York, Section 13, *The Continuous Distillation Process*.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is generally adiabatic and can include integral (stagewise) or differential (continuous) contact between the phases. Separation process arrangements that utilize the principles of rectification to separate mixtures are often interchangeably termed rectification columns, distillation columns, or fractionation columns. Cryogenic rectification is a rectification process carried out at least in part at temperatures at or below 150 degrees Kelvin (K).

As used herein the term "indirect heat exchange" means the bringing of two fluid streams into heat exchange relation without any physical contact or intermixing of the fluids with each other.

As used herein the term "top condenser" means a heat exchange device that generates column downflow liquid from column vapor.

As used herein the terms "upper portion" and "lower portion" mean those sections of a column respectively above and below the midpoint of the column.

As used herein the term "regenerator" means a heat exchange device having a shell and one or more hollow coils passing therethrough. The coil side of the regenerator is the volume within the coil(s). The shell side of the regenerator is the volume within the shell but outside the coil(s).

As used herein the term "cooling period" means a period of time during which feed air is passing through the shell side of the regenerator prior to being passed into a column, and as used herein the term "non-cooling period" means a period of time during which such feed air is not passing through the shell side of the regenerator.

As used herein the term "exogenous cryogenic liquid" means a liquid which is not ultimately derived from the feed and is at a temperature of 150 K or less. Preferably the exogenous cryogenic liquid is comparable in purity to the product nitrogen.

DETAILED DESCRIPTION

In the practice of this invention the use of exogenous cryogenic liquid addition reduces or removes entirely the need for turboexpansion to generate refrigeration and also increases the mass flow and therefore the total thermal capacity of the outgoing streams, causing the cold end temperature difference to decrease and reducing or eliminating the need for unbalance in the regenerator.

Figure 1:
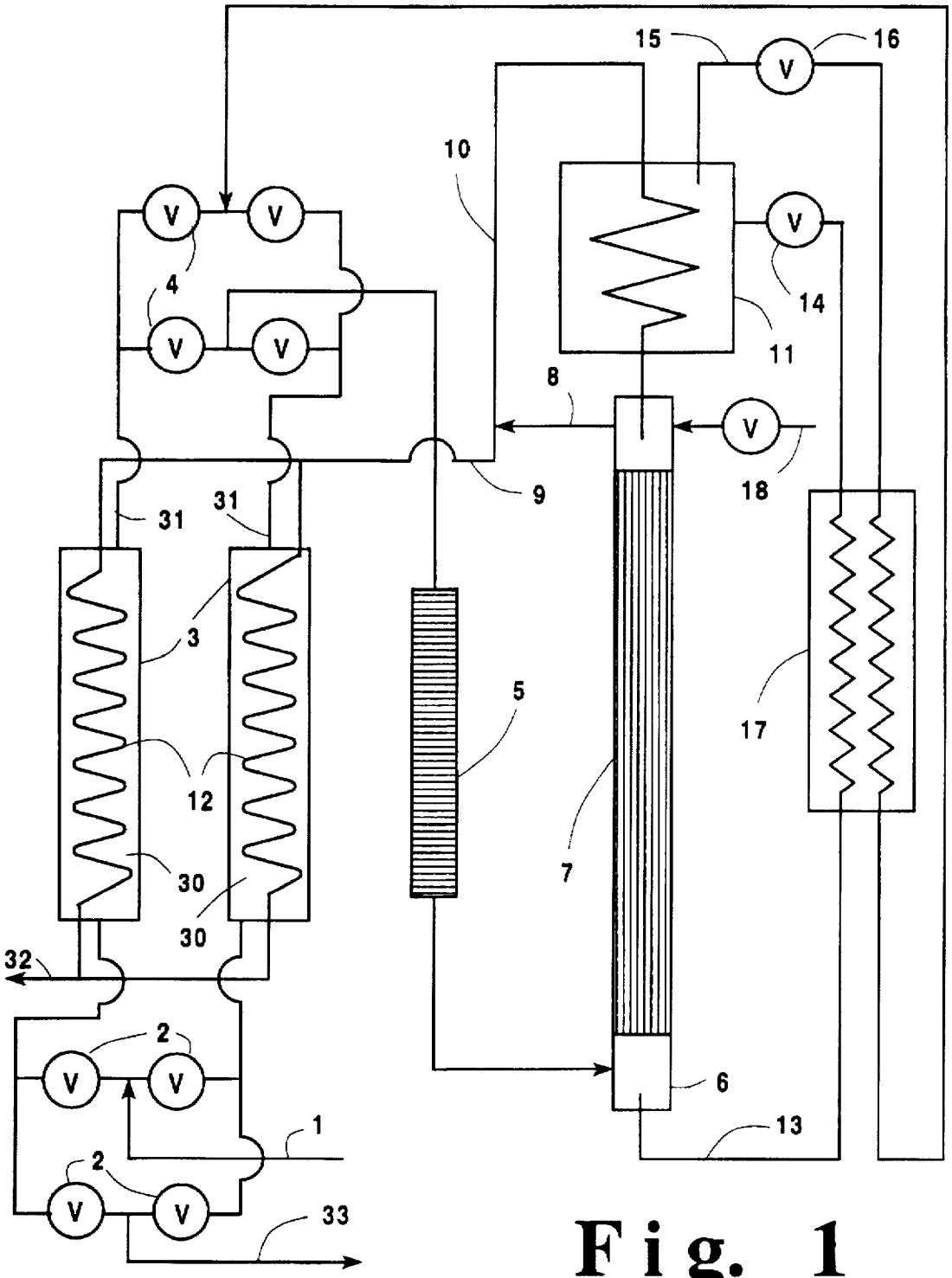
FIG. 1 is a schematic representation of one preferred embodiment of the cryogenic rectification system of the invention.

The invention will be described in detail with reference to the Drawings. Referring now to FIG. 1, feed air is compressed to typically between 30 and 200 pounds per square inch absolute (psia), after which it is typically cooled and free water is removed. The compressed feed air stream 1 is then diverted through a switching valve 2 to the shell side 30 of one of a pair of regenerators 3, which generally contain a packing material, such as stones, within the shell. During such cooling period the feed air is cooled close to its dewpoint by passage through shell side 30 and all remaining water and most of the carbon dioxide is removed from the feed air by condensation. The cooled feed air is withdrawn from shell side 30 in stream 31 and is passed through check valve 4 to an adsorbent bed 5 for removal of hydrocarbons and any remaining carbon dioxide that exit with the feed air from the cold end of the regenerator. The adsorbent is typically a silica gel. The clean cold air is then passed into the lower portion of rectifying column 6 which contains mass transfer devices 7 such as distillation trays or packing and is operating at a pressure within the range of from 30 to 200 psia. Within column 6 the feed air is separated by cryogenic rectification into nitrogen vapor and oxygen-enriched liquid.

Nitrogen vapor, having a nitrogen concentration of at least 95 mole percent, is withdrawn from the upper portion of column 6 as stream 8 and divided into a first portion or reflux stream 10 and a second portion or product stream 9. Reflux stream 10 passes to top condenser 11 wherein it is condensed and returned to column 6 as liquid reflux. Product stream 9 is passed into the coil side of regenerators 3 and through coils 12 which are imbedded inside the regenerator packing material. Warm product leaving the regenerators (typically 5–15 K colder than the incoming feed air) is then withdrawn from the coil side of the regenerators and recovered as product nitrogen 32 at a flowrate generally within the range of from 30 to 60 mole percent of the incoming feed air flowrate and having a nitrogen concentration of at least 95 mole percent.

Oxygen-enriched liquid is withdrawn from the lower portion of column 6 as kettle liquid 13, and is pressure transferred to top condenser 11. This kettle liquid typically contains more than 30 mole percent oxygen. Preferably kettle liquid in stream 13 is subcooled by passage through heat exchanger 17 prior to being passed into top condenser 11. The boiling pressure inside top condenser 11 is significantly lower than the pressure at which column 6 is operating thus allowing the transfer of the kettle liquid. The rate of flow of the kettle liquid is governed by a flow restricting device such as a control valve 14. Additional adsorbent may be located in the kettle liquid transfer line or in the condenser for final scavenging of residual hydrocarbons and carbon dioxide. The oxygen-enriched liquid in the top condenser is boiled against the condensing nitrogen reflux stream. Top condenser 11 operates at a much reduced pressure over that of the column 6. Generally the pressure of the top condenser will be at least 10 psi less than that at which column 6 is operating. This reduces the boiling temperature of the oxygen stream to below the temperature at which the nitrogen vapor, at column pressure, condenses. The resulting oxygen-enriched vapor 15, which will be termed the waste, passes out of top condenser 11 through a control valve 16 that regulates the boiling side pressure and hence the column pressure. The waste then passes in countercurrent heat exchange relation with the rising kettle liquid in a heat exchanger or superheater 17. Waste then passes through check valves 4 and into the cold end of the shell side of the regenerator 3 which does not have feed air passing through it, i.e. during a non-cooling period. The regenerators will switch via switching valves 2 between feed air and waste in a periodic fashion so that each regenerator experiences both cooling and non-cooling periods. The waste is withdrawn from the system in stream 33. Typically the nitrogen vapor will pass through a regenerator during both the cooling and non-cooling periods.

Exogenous cryogenic liquid, which in the embodiment illustrated in FIG. 1 is liquid nitrogen having a nitrogen concentration of at least 95 mole percent, is added from an external source to the column through line 18 to provide refrigeration to the system. The flow of the exogenous cryogenic liquid is regulated to maintain the liquid level inside the condenser 11 and is within the range of from 2 to 15 percent of the flowrate of nitrogen product stream 32 on a molar basis. Alternatively, some or all of the required exogenous cryogenic liquid may be added to the top condenser.

One of the difficulties of regenerators is that for extended operation it is necessary to have very small temperature differences between the feed air and waste streams. As the feed air passes through the regenerator, water and carbon dioxide freeze out onto the packing material and the outer surface of the coils inside the regenerator. This frost must be removed by the returning cold waste stream or it will accumulate and eventually plug the regenerator. The waste stream has less mass flow than does the feed air coming in. Also it is at a lower temperature. Both of these facts tend to reduce the ability of the waste stream to hold moisture and carbon dioxide.

Self cleaning depends on a delicate balance between the waste/air temperature difference ($\Delta T$) and the waste/air flow and pressure ratios. Increasing the waste to air flow ratio reduces the amount of product recovered. Increasing the pressure ratio increases the column pressure which reduces separation efficiency and also consumes more power for compression. Thus the most effective means of assuring self cleaning is to ensure that the temperature differences are small. The variation of vapor pressure with temperature is such that the self cleaning requirements in terms of allowable $\Delta T$ are more severe for carbon dioxide than water. As a result, since water is removed at the warm end of the regenerator while carbon dioxide is removed at the cold end, large warm end temperature differences are more tolerable than large cold end temperature differences. Unfortunately the heat capacity of the high pressure air entering the plant exceeds that of the cold streams derived from the air coming out at lower pressure. This unbalances the regenerator such that tight temperature differences are obtainable at the warm end but not at the cold end. In order to make regenerators self cleaning, unbalance passages are conventionally used which increase the flow ratio of cold streams (referring to both the waste stream and product stream) to feed air in the cold end of the regenerator and cause the cold end temperature difference to tighten. While this may be accomplished in several ways, each arrangement increases the ratio of cold stream mass flow to air mass flow in the cold end of the regenerator and each requires additional piping, perhaps additional control and either additional coils within the regenerators or the addition of an additional adsorbent bed to remove carbon dioxide from air removed at an intermediate level in the regenerator.

With the practice of this invention, wherein exogenous cryogenic liquid is added to the column and/or the top condenser at a flowrate within the range of from 2 to 15 percent of the flowrate of the nitrogen product stream on a molar basis, the requirement for cold end unbalance on the regenerator is reduced or even eliminated.

Figure 2:
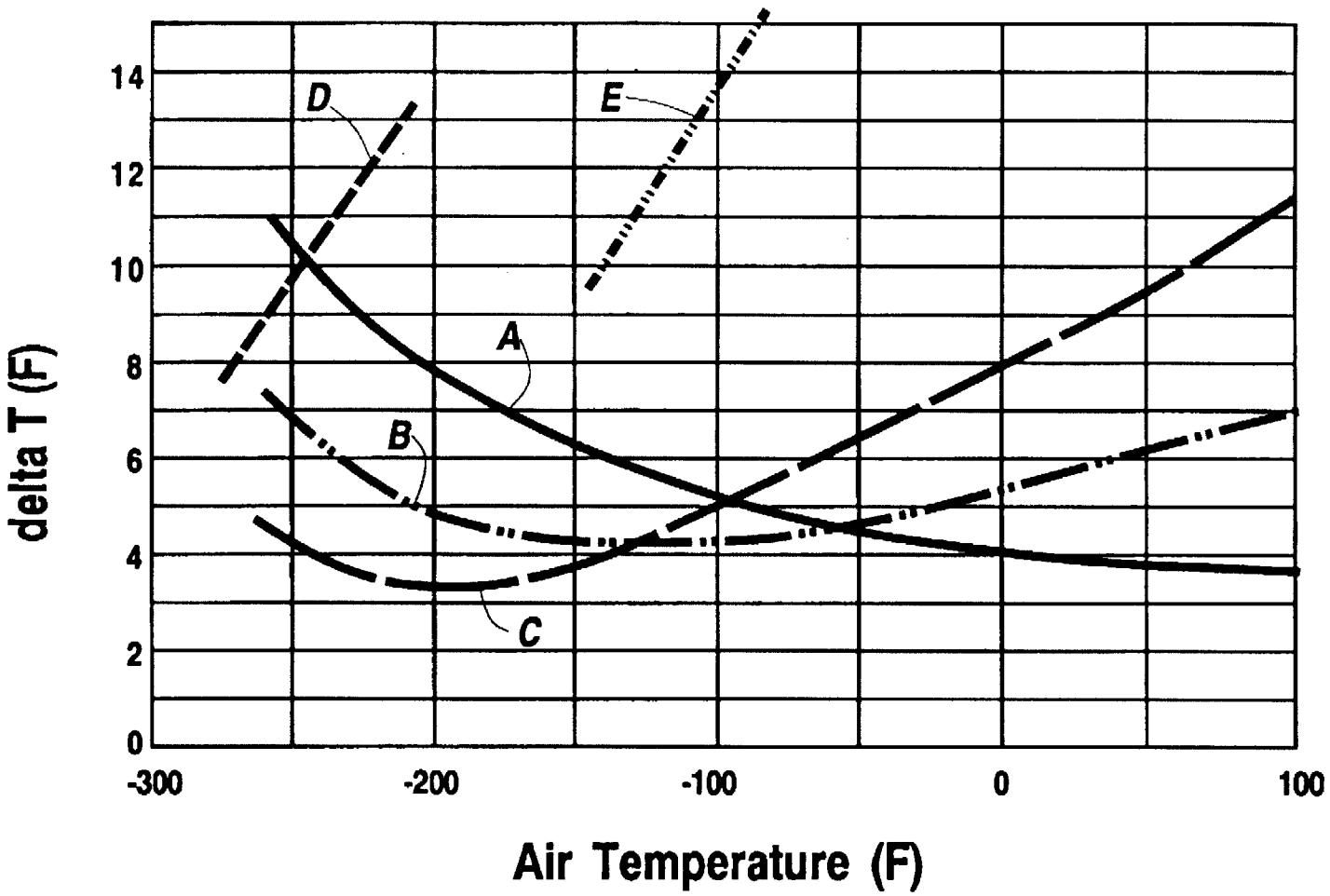
FIG. 2 is a graph showing the temperature difference between feed air and waste flow under several conditions and the requirements for proper regenerator cleaning.

The following example is provided to illustrate the invention and to provide comparative data. The example is not intended to be limiting. The example is presented considering a process arrangement similar to that illustrated in FIG. 1. A steady state regenerator has a UA of 50,000 BTU/hr/F. A 100 lbmols/hr air stream enters the warm end of the regenerator at 120° F. and 100 psia. Waste and product streams enter the cold end of the heat exchanger at −270° F. The waste stream flow is 60 lbmols/hr and pressure is 16 psia. The product stream flow is 40 lbmols/hr and pressure is 98 psia. The product stream is assumed to be pure nitrogen. The waste composition is set by mass balance (~63 mole percent nitrogen). For the purposes of this analysis, it is assumed that the waste and product also exit the warm end of the heat exchanger at the same temperature. FIG. 2 shows as Curve A the temperature difference between the air and a composite stream representing the sum of the returning cold streams as a function of air temperature when no exogenous cryogenic liquid is added to the column. This relationship is also shown at exogenous cryogenic liquid addition rates of 5 and 10 percent of the product flowrate on a molar basis as curves B and C respectively. It can be seen that increasing the exogenous cryogenic liquid addition rate reduces the cold end $\Delta T$ and increases the warm end $\Delta T$.

Also shown is the air/waste temperature difference required to remove carbon dioxide and water, curves D and E respectively, assuming that the waste and air streams are saturated throughout. This temperature difference is approximated using equation (1).

$$\left(\frac{Pi(Ta)}{Pa - Pi(Ta)}\right) Qa = \left(\frac{Pi(Tw)}{Pw - Pi(Tw)}\right) Qw \tag{1}$$

where Pi(T) is the vapor pressure (psia) exerted by component i at temperature T (F), P is the pressure (psia), Q is the flow (lbmol/hr) and T is temperature at any point (F). Subscripts a and w refer to air and waste respectively. Equation (1) is an approximate relationship that serves to illustrate the form of the self cleaning curves. It represents the condition where at any point in the regenerator the waste stream at saturation can carry the same amount of water and carbon dioxide as the air stream.

It can be seen from FIG. 2 that in the absence of the addition of exogenous cryogenic liquid to the column, the air/waste temperature difference exceeds that required for carbon dioxide removal, that the system removes carbon dioxide more easily when exogenous cryogenic liquid is added to the column, and that at some minimum exogenous cryogenic liquid addition rate, the need for unbalance streams in the cold end of the regenerator is eliminated.

Since the use of a turboexpander to generate refrigeration is not required, it is not necessary to maintain an elevated waste stream pressure. Thus, the pressure on the boiling side of top condenser need only be sufficient to drive the waste flow through the regenerator and piping to vent. The lower the pressure on the boiling side of the top condenser, the lower the temperature of the boiling mixture. For a fixed condensing pressure, this results in a large temperature difference in the top condenser.

The heat duty in the condenser can be expressed as follows;

$$Q=U_cA_c\Delta T \quad (2)$$

where Q is the heat transferred (BTU/hr), $U_c$ is the overall heat transfer coefficient for the condenser (BTU/hrft$^2$F), $A_c$ is the area between the condensing and boiling regions (ft$^2$) and $\Delta T$ is the temperature difference (F) between the boiling and condensing fluids. From equation (2) it is clear that increasing $\Delta T$ decreases the $U_cA_c$ required for a given heat duty.

Figure 3:
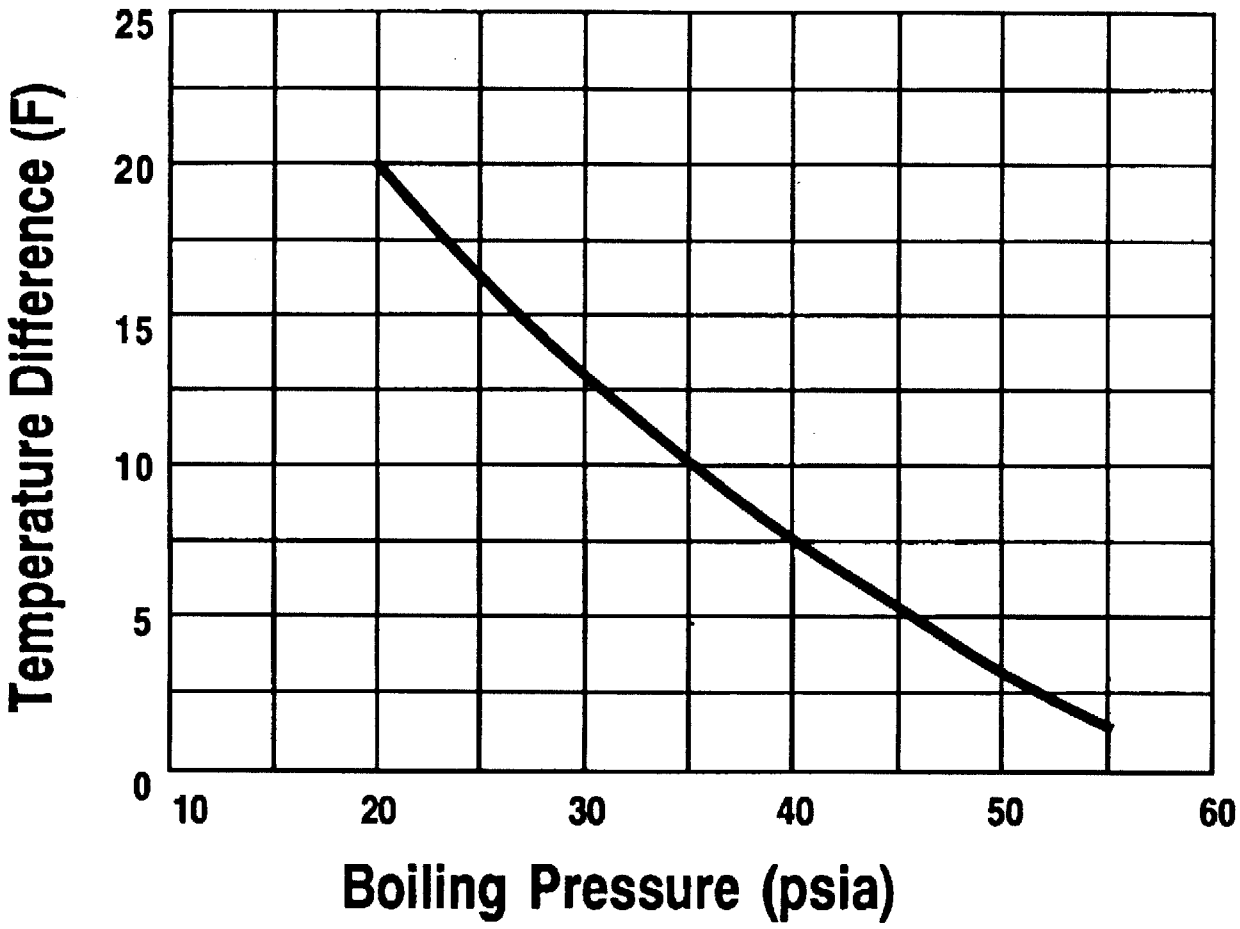
FIG. 3 is a graph showing the temperature difference across the top condenser in a typical embodiment of the invention.

As demonstrated, liquid addition allows the waste to operate at a pressure substantially lower than the column pressure. Since in most applications the nitrogen is required at pressure, the pressure difference between the condensing and boiling streams is generally at least 10 psi and may exceed 50 psi. FIG. 3 shows the temperature difference across the condenser for the case of pure nitrogen condensing at 100 psia and a boiling waste stream with a vapor composition of 63 mole percent nitrogen.

An additional advantage of operating the top condenser at high temperature differences is that while the condensing side heat transfer coefficient is not a strong function of temperature, the boiling side coefficient increases rapidly with temperature difference. Thus operating with a large pressure difference between the column and the top condenser results in larger overall heat transfer coefficients as well as larger $\Delta T$. As a result, the area of the condenser is much reduced.

A particularly advantageous embodiment of the invention employs a coil in shell top condenser. The waste liquid boils inside a shell with coiled tubes immersed in the liquid. Nitrogen from the upper portion of the column condenses on the inside of the tubes.

Now by the use of this invention one can produce nitrogen by cryogenic rectification using regenerators, especially at lower production rates such as 20,000 cfh-NTP or less, without need for unbalancing the cold end of the regenerator.

Although the invention has been described in detail with reference to one preferred embodiment those skilled in the art will recognize that there are other embodiments of the invention within the spirit and the scope of the claims.

We claim:

1. A method for producing nitrogen by the cryogenic rectification of feed air using a regenerator having a shell side and a coil side, said method comprising:

(A) cooling feed air by passing the feed air through the shell side of a regenerator during a cooling period, and introducing the cooled feed air into a column;

(B) passing exogenous cryogenic liquid into the column and separating the feed air by cryogenic rectification within the column into nitrogen vapor and oxygen-enriched liquid;

(C) condensing a first portion of the nitrogen vapor by indirect heat exchange with oxygen-enriched liquid to produce oxygen-enriched vapor;

(D) warming a second portion of the nitrogen vapor by indirect heat exchange with said cooling feed air by passing said second portion of the nitrogen vapor through the coil side of the regenerator;

(E) recovering the warmed second portion of the nitrogen vapor as product nitrogen; and (F) passing oxygen-enriched vapor through the shell side of the regenerator during a non-cooling period.

2. The method of claim 1 wherein the exogenous cryogenic liquid is passed into the column at a flowrate within the range of from 2 to 15 percent of the flowrate at which product nitrogen is recovered on a molar basis.

3. The method of claim 1 wherein the exogenous cryogenic liquid is passed into the column in the upper portion of the column.

4. The method of claim 1 wherein the column is operating at a pressure within the range of from 30 to 200 psia and the oxygen-enriched liquid is at a pressure at least 10 psi less than the operating pressure of the column during the indirect heat exchanger with the condensing first portion of the nitrogen vapor.

5. Apparatus for producing nitrogen by the cryogenic rectification of feed air comprising:

(A) a regenerator having a shell side and a coil side;

(B) a column having a top condenser;

(C) means for passing feed air into the shell side of the regenerator, means for passing feed air from the shell side of the regenerator into the column, and means for passing exogenous cryogenic liquid into at least one of the column and the top condenser;

(D) means for passing vapor from the column into the top condenser and means for passing liquid from the column into the top condenser;

(E) means for passing vapor from the upper portion of the column into the coil side of the regenerator and means for recovering vapor from the coil side of the regenerator as product nitrogen; and (F) means for passing vapor from the top condenser into the shell side of the regenerator.

6. The apparatus of claim 5 wherein the means for passing exogenous cryogenic liquid communicates with the column.

7. The apparatus of claim 6 wherein the means for passing exogenous cryogenic liquid communicates with the column in the upper portion of the column.

8. A method for producing nitrogen by the cryogenic rectification of feed air using a regenerator having a shell side and a coil side, said method comprising:

(A) cooling feed air by passing the feed air through the shell side of a regenerator during a cooling period, and introducing the cooled feed air into a column having a top condenser;

(B) separating the feed air by cryogenic rectification within the column into nitrogen vapor and oxygen-enriched liquid;

(C) passing exogenous cryogenic liquid into the top condenser and condensing a first portion of the nitrogen vapor by indirect heat exchange with oxygen-enriched liquid to produce oxygen-enriched vapor;

(D) warming a second portion of the nitrogen vapor by indirect heat exchange with said cooling feed air by passing said second portion of the nitrogen vapor through the coil side of the regenerator;

(E) recovering the warmed second portion of the nitrogen vapor as product nitrogen; and (F) passing oxygen-enriched vapor through the shell side of the regenerator during a non-cooling period.

* * * * *